US006322114B1

(12) United States Patent
Kurachi et al.

(10) Patent No.: US 6,322,114 B1
(45) Date of Patent: Nov. 27, 2001

(54) LATCH UNIT WITH DISENGAGEMENT PREVENTING DEVICE

(75) Inventors: Katsuhito Kurachi, Nisshin; Naohiro Shimajiri, Toyota, both of (JP)

(73) Assignee: Nifco Inc., Yokohama (JP)

( * ) Notice: Subject to any disclaimer, the term of this patent is extended or adjusted under 35 U.S.C. 154(b) by 0 days.

(21) Appl. No.: 09/388,552

(22) Filed: Sep. 2, 1999

(30) Foreign Application Priority Data

Sep. 8, 1998 (JP) ..... 10-269026

(51) Int. Cl.[7] ..... E05B 15/02

(52) U.S. Cl. ..... 292/341.17; 292/341.15; 292/340; 292/303

(58) Field of Search ..... 292/340, 341.15, 292/341.17, 303

(56) References Cited

U.S. PATENT DOCUMENTS 4,871,629 * 10/1989 Bunyea ..... 292/341.15 X
5,186,516 * 2/1993 Alexander et al. ..... 296/121
5,520,424 * 5/1996 Hapke et al. ..... 292/198
5,613,718 * 3/1997 Lin ..... 292/346
6,106,035 * 8/2000 Hetherington ..... 292/251

* cited by examiner

*Primary Examiner*—Teri Pham Luu
(74) *Attorney, Agent, or Firm*—Kanesaka & Takeuchi

(57) ABSTRACT

A latch unit of the invention includes a casing having a holding chamber for holding a striker and a side chamber situated adjacent to the holding chamber, and a responding member housed in the side chamber. The holding chamber and the side chamber are partitioned by an elastic member projecting toward an introduction opening of the holding chamber for introducing the striker to be attached to the latch unit. The electric member is provided with an engaging projection for engaging the striker as the striker is inserted into the holding chamber. The side chamber is provided with an urging device for urging the responding member toward a base portion of the elastic member. An urging force of the urging device is set such that when an inertia force is applied to release an engagement of the elastic member and the striker to thereby extract the striker from the holding chamber, the responding member is allowed to move to a position for preventing the elastic member from being bent toward the side chamber. Thus, engagement of the latch and the striker is not released in case of emergency.

8 Claims, 5 Drawing Sheets

LATCH UNIT WITH DISENGAGEMENT PREVENTING DEVICE

BACKGROUND OF THE INVENTION AND RELATED ART STATEMENT

The invention relates to a latch unit for constituting an attaching device for fixing a fixed member and a movable member in cooperation with a striker. The latch unit is used in various equipments including the fixed and movable members and installed in compartments of a car, train, airplane or the like, wherein the latch unit is generally provided at the fixed member and is allowed to engage the striker provided at the movable member so that the movable member is held in a front position with respect to the fixed member.

If there are a fixed member and a movable member, and if it is necessary to attach the movable member to the fixed member at a front position, such as a body portion and a cover of a console box, a body member and a cover member of a glove box installed in a compartment of a car, a rear surface of a seat and a supplementary table rotatably fixed thereto in a train, or a luggage shelf and its cover in an airplane, there has been often used an attaching device including a striker and a latch for receiving the striker therein. The latch includes an elastic member provided with an engaging projection for elastically engaging an engaging portion of the striker as the striker is received therein.

However, in the car or the like, the striker may be unexpectedly disengaged from the latch due to the situation that the moving member is moved by an inertia force or impact force applied thereto by a collision or sudden braking of the car. This unexpected disengagement is desirably prevented. Such a situation can be prevented by increasing an engaging force between the striker and the latch. However, in case such an engaging force is merely increased, there may be disadvantages such that it is difficult to carry out an inserting and engaging operation of the striker with the latch, and an extraction and releasing operation of the striker from the latch.

Of course, in case inertia force or impact force is applied thereto, an emergency lock mechanism for not releasing the engagement of the striker and the latch may be provided separately. However, it is desirable to easily incorporate such a mechanism into the attaching device, so that labor for assembling the car and a weight of the car can be reduced, and the car can be supplied at a lower price.

In view of the above requirements, the present invention has been made, and an object of the invention is to provide a latch unit, wherein there is incorporated a mechanism for preventing the latch and the striker from being disengaged from each other due to the inertia force or impact force applied thereto in case of emergency of a car, without causing any problem in engaging and disengaging operations of the striker and the latch in the normal state.

Another object of the invention is to provide a latch unit as stated above, wherein the engagement release preventing function in case of emergency can be properly provided to an attaching device, which can be made only by attaching the latch unit.

A further object of the invention is to provide a latch unit as stated above, wherein labor for assembling the attaching device can be reduced to thereby supply the car at a lower price.

Further objects and advantages of the invention will be apparent from the following description of the invention.

SUMMARY OF THE INVENTION

In order to attain the above objects, a latch unit of the present invention includes: a casing having a holding chamber for holding a striker therein and a side chamber adjacent to the holding chamber, and to be inserted into an attaching hole formed on an object to which the casing is attached; a responding member movably housed in the side chamber; an introduction opening provided in the casing for introducing the striker therethrough and communicating with the holding chamber; an elastic member projecting toward the introduction opening from an inner deep portion of the holding chamber so that the holding chamber and the side chamber are partitioned, the elastic member having an engaging projection to be engaged with the striker, so that after the elastic member is bent toward the side chamber by an engaging portion of the striker as the striker is inserted into an inner side of the holding chamber through the introduction opening, the elastic member is returned to an original position by positioning the striker in a predetermined position to thereby allow the engaging projection of the elastic member to engage with the engaging portion of the striker to prevent the engaging portion of the striker from being extracted from the holding chamber; and an urging device for always urging the responding member to be positioned on a side of the base portion of the elastic member in the side chamber. An urging force of the urging device is set such that when an inertia force or impact force for allowing the striker to be extracted from the holding chamber by releasing an engagement of the engaging projection of the elastic member and the engaging portion of the striker is applied thereto, the responding member is allowed to move toward a projecting edge of the elastic member to prevent the elastic member from being bent toward the side chamber.

According to the structure, the engaging portion of the striker is engaged with the engaging projection of the elastic member as the striker is inserted into the holding chamber of the latch unit through the introduction opening, so that a member to which the striker is provided can be attached to an object to which the latch unit is attached with one touch operation.

Also, in case at least the inertia force or impact force having such a big force as described above is applied thereto, the responding member is allowed to move toward the position for preventing the elastic member from being bent toward the side chamber, i.e. toward the projecting edge of the elastic member. Thus, the responding member prevents the elastic member from being bent toward the side chamber to thereby prevent the striker from being extracted from the holding chamber, in other words, prevent the member to which the striker is attached from being separated from the object to which the latch unit is attached, due to the inertia force or impact force.

As a result, it is not necessary to excessively increase an engaging force of the elastic member with respect to the engaging projection of the striker, and large pushing-in and pulling-out forces are not required for inserting the striker into the latch or engagement operation, and pulling out the striker from the latch or engagement releasing operation in a normal situation.

Also, the attaching device having a function for preventing the striker from being extracted when the inertia force or impact force is applied thereto can be easily provided to a member which require such an attaching device, by installing the casing into an attaching hole formed on the member.

Also, as far as the inertia force or impact force is not applied, since the responding member can be stably located at a position where the responding member does not prevent the elastic member from being bent toward the side chamber, even if the latch unit is attached so that a front surface of the casing faces upwards, sidewards or downwards, any operation of insertion of the striker into the holding chamber or engagement operation, and extraction of the striker from the holding chamber or releasing operation can be carried out without any problem in the normal operation.

DETAILED DESCRIPTION OF A PREFERRED EMBODIMENT

With reference to FIGS. 1 to 11, an embodiment of a latch unit according to the present invention is explained.

Figure 1:
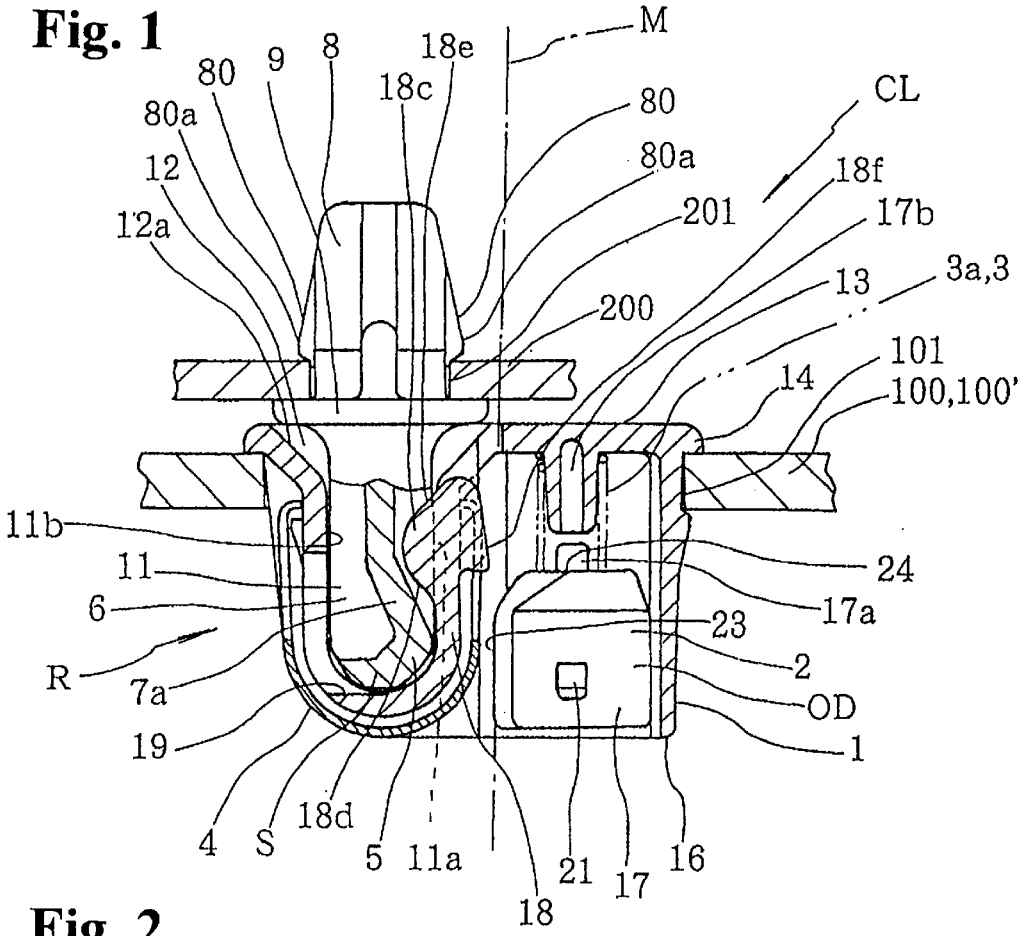
FIG. 1 is a sectional view showing a using state of a latch unit according to the present invention.

Incidentally, in FIG. 1, in order to easily understand an engaging state of a latch unit R and a striker S under a condition that a predetermined inertia force or impact force is not applied thereto, the latch unit R and the striker S are shown in section. Also, in FIG. 2, the latch unit R and the striker S are shown in section similar to FIG. 1, under a condition that the predetermined inertia force or impact force is applied thereto.

Figure 4:
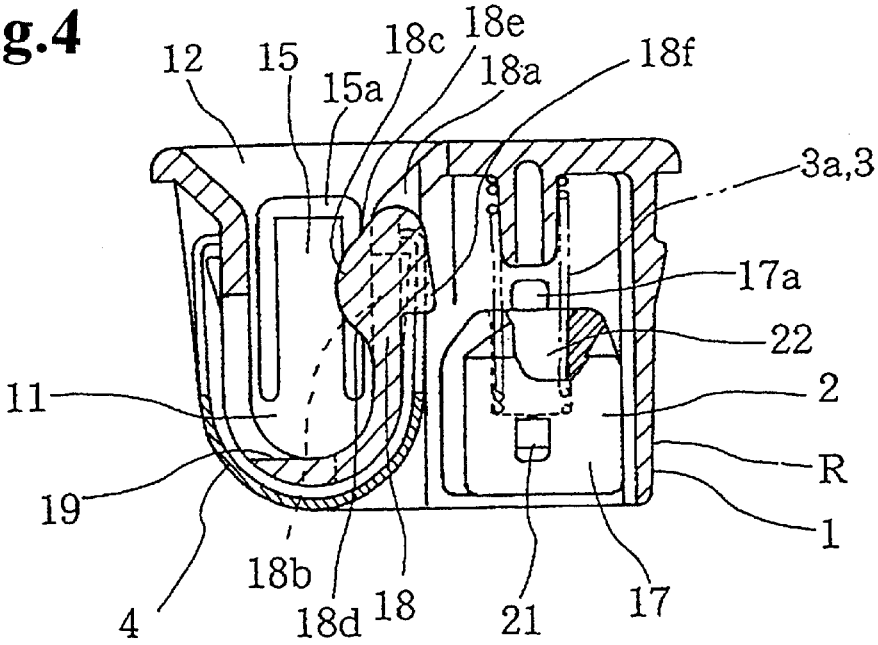
FIG. 4 is a vertical sectional view of the latch unit.
Figure 5:
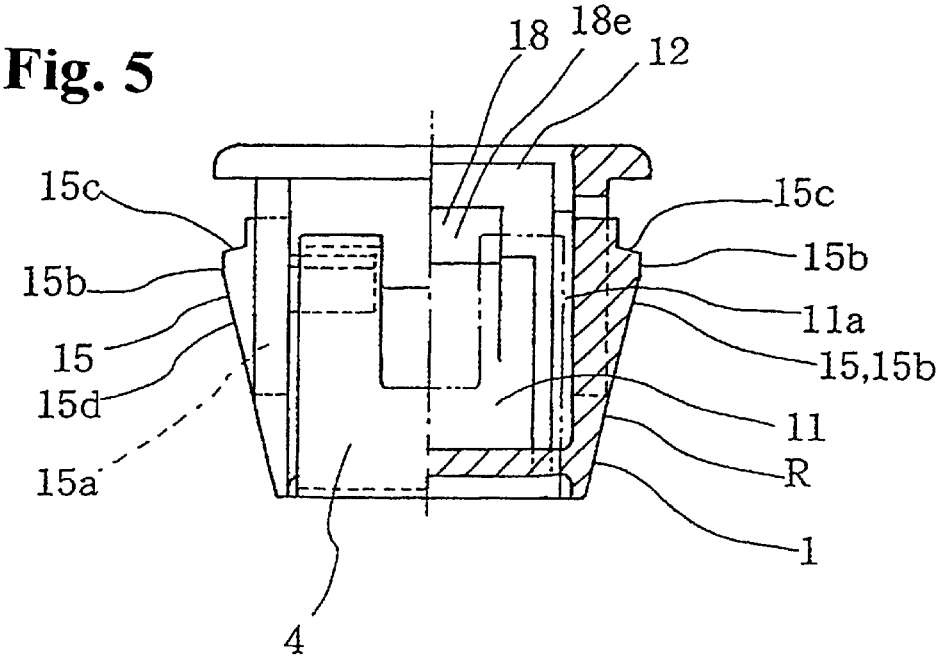
FIG. 5 is a partially cut vertical sectional view of the latch unit viewed from a side different from FIG. 3.
Figure 6:
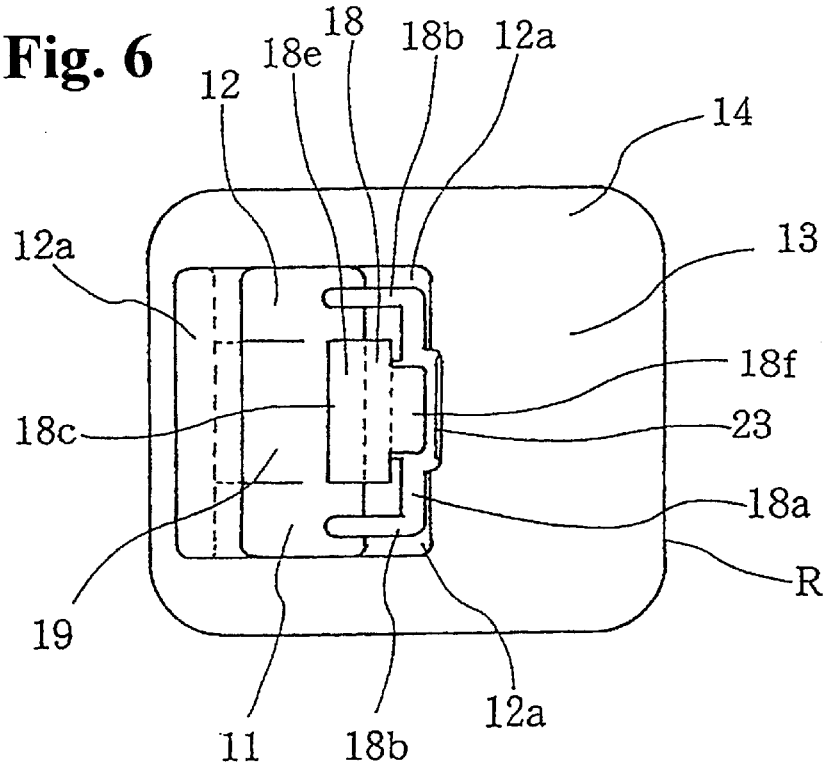
FIG. 6 is a plan view of the latch unit.
Figure 7:
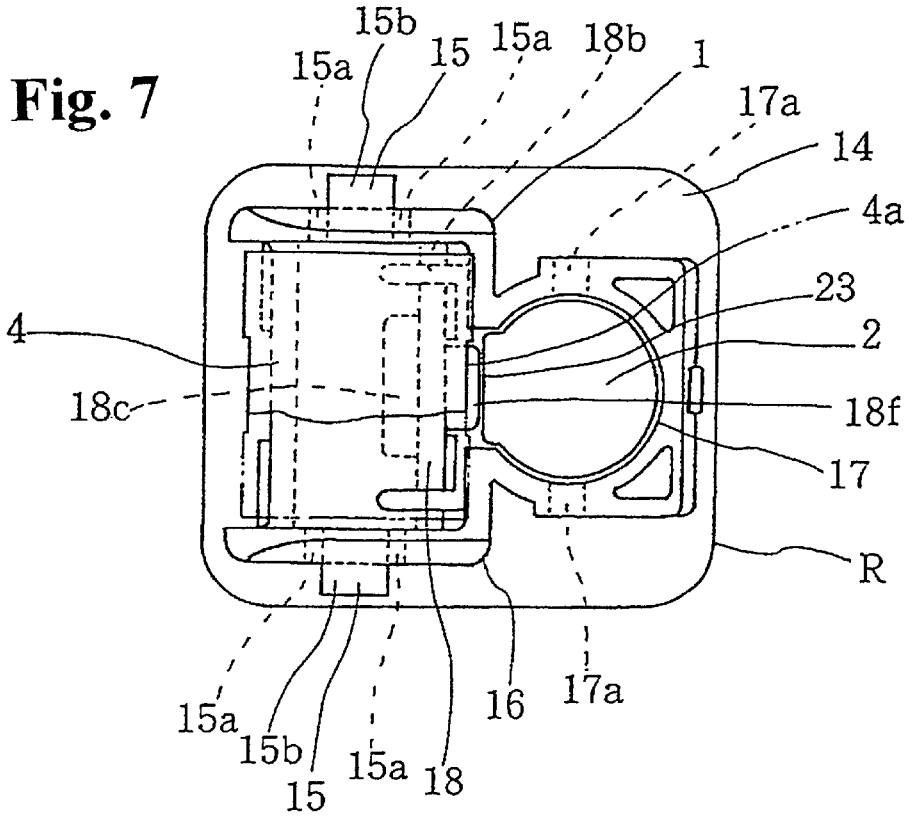
FIG. 7 is a bottom view of the latch unit.
Figure 8:
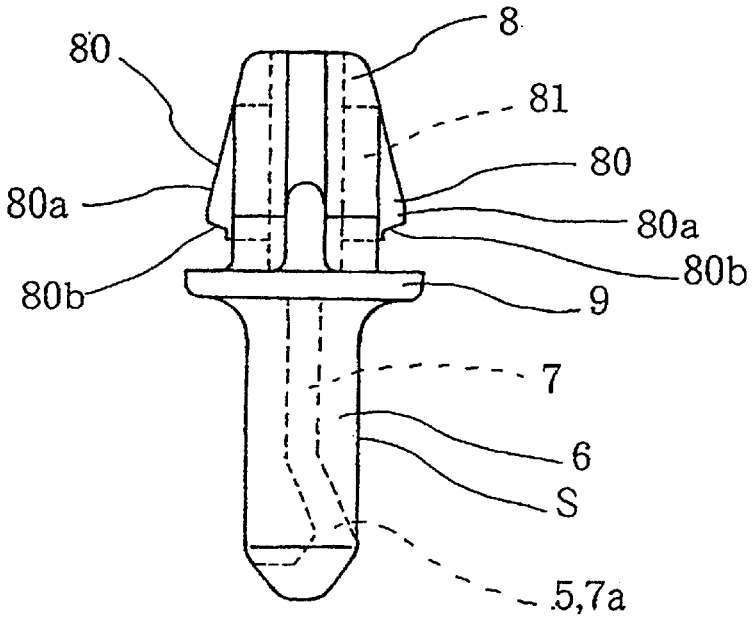
FIG. 8 is a side view of a striker.

Also, FIGS. 3 to 7 show the latch unit R, respectively, wherein FIG. 4 is a vertical sectional view; FIG. 5 is a diagram viewed from a left side of the latch unit R shown in FIG. 3, and a right half of the latch unit R is shown in section; FIG. 6 is a diagram viewed from an upper side of the latch unit R shown in FIG. 3, wherein a spring plate 4 which will be described later is omitted; and FIG. 7 is a diagram viewed from a lower side of the latch unit R shown in FIG. 3.

Figure 9:
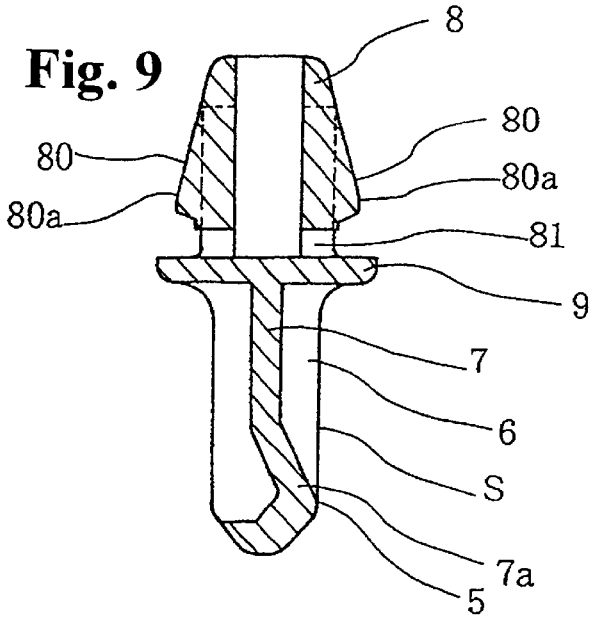
FIG. 9 is a vertical sectional view of the striker.
Figure 10:
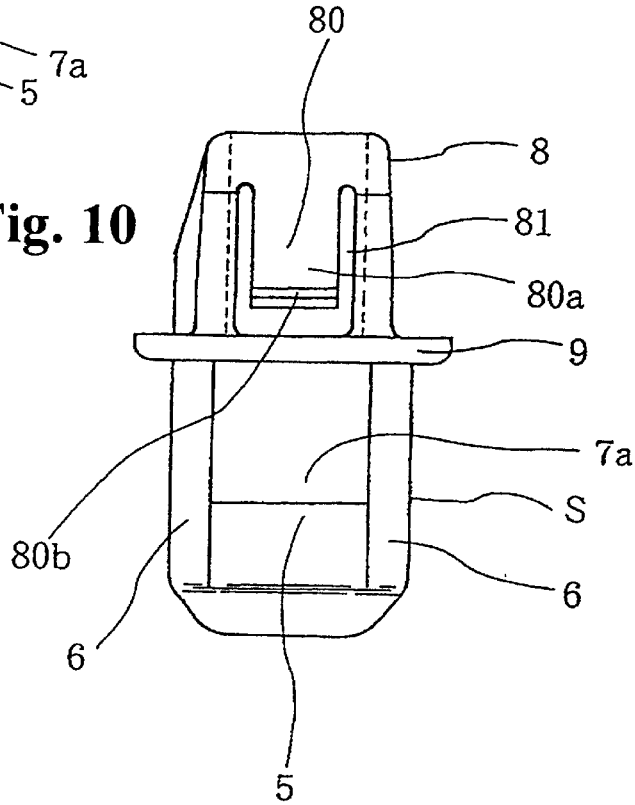
FIG. 10 is a side view of the striker viewed from a side different from FIG. 8.
Figure 11:
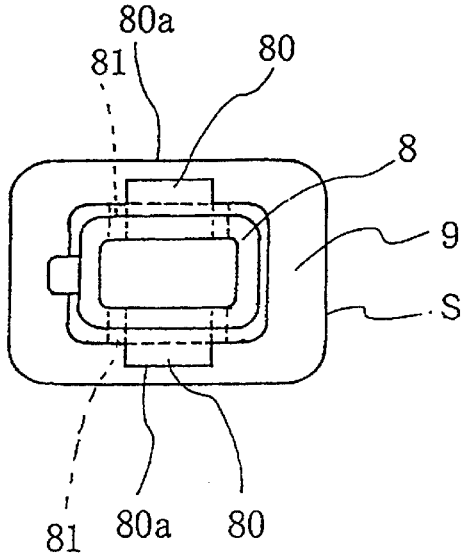
FIG. 11 is a plan view thereof.

Also, FIGS. 8 to 11 show the striker S to be engaged with the latch unit R according to the present embodiment, wherein FIG. 9 is a vertical sectional view; FIG. 10 is a diagram viewed from a right side of the striker S shown in FIG. 8; and FIG. 11 is a diagram viewed from an upper side of the striker S shown in FIG. 10.

According to the present embodiment, the latch unit is used in various equipments having a fixed member 100, and a movable member 200, to be installed in a compartment of a car, train, aircraft or the like, and the movable member 200 is held at a front position CL of the fixed member 100. The latch unit R is generally provided to the fixed member 100 to engage the striker S provided to the movable member 200 at the front position CL.

More specifically, the latch unit R according to the present embodiment includes a casing 1 having a holding chamber 11 for holding the striker S therein, and an introduction opening 12 communicating with the holding chamber 11 for introducing the striker S therethrough. The casing 1 has an outer flange portion 14 surrounding a front surface 13 provided with the introduction opening 12, and elastic attaching members 15 formed on opposed side surfaces by slits 15*a* to enable a portion thereof at a side of the outer flange portion 14 to elastically deform toward the inside of the casing 1. Each elastic attaching member 15 includes, on an outer edge portion on the side of the outer flange portion 14, a projecting portion 15*b* having an engaging surface 15*c* facing the outer flange portion 14 with a space between the outer flange portion 14 and the projecting portion 15*b*. Each projecting portion 15*b* includes an inclined surface 15*d* gradually lowering the size from a top edge thereof toward a rear surface 16 of the casing 1.

Thus, the latch unit R can be installed in the object 100' to which the latch unit R is attached such that the latch unit R is inserted into an attaching hole 101 having a shape similar to an outer shape of the casing 1 and provided to the object 100' from the rear surface 16 of the casing 1. Thus, the inclined surfaces 15*d* of the projecting portions 15*b* are pressed against a hole edge of the attaching hole 101 to thereby gradually allow the elastic attaching members 15 provided with the projecting portions 15*b* to bend inside the casing 1. Then, the elastic attaching members 15 are elastically returned to the original shapes after the top edges of the projecting portions 15*b* have passed over the hole edge of the attaching hole 101, so that the casing 1 is inserted into the attaching hole 101 where the hole edge is sandwiched by the outer flange portion 14 and the engaging surfaces 15*c*. Thus, the latch unit R can be attached to the object 100' with one touch operation.

Also, the latch unit R includes a side chamber 17 adjacent to the holding chamber 11 for holding the striker S. The holding chamber 11 and the side chamber 17 are partitioned by an elastic piece 18 projecting from a side of an inner deep portion 19 toward the introduction opening 12 of the striker S. In detail, a slit 18*a* extending in a widthwise direction of the casing 1 on the front side 13 thereof and vertical slits 18*b* connected to both ends of the slit 18*a* and extending toward the rear surface 16 of the casing 1 are formed between the holding chamber 11 and the side chamber 17. In other words, an elastic member 18 is formed of the slit 18*a* and the vertical slits 18*b*.

The elastic member 18 is provided with an engaging projection or portion 18*c* projecting inside the holding chamber 11 on a projecting side thereof, i.e. on the side of the introduction opening 12 of the striker S. The engaging projection 18*c* includes an engaging surface 18*d* facing a base portion of the elastic member 18, i.e. the inner deep portion 19 of the holding chamber 11, and an inclined surface 18*e* gradually decreasing the size toward the projecting side from a top portion of the elastic member 18.

As a result, in the present embodiment, in case the striker S having a certain length and provided with an engaging projection 5 projecting toward the elastic member 18 is inserted into the holding chamber 11 through the introduction opening 12 of the latch unit R, the engaging projection 5 of the striker S is engaged with the engaging projection 18*c*. Thus, the member provided with the striker S can be fixed to the object 100' to which the latch unit R is attached, with one touch operation.

More specifically, when the striker S is inserted into the holding chamber 11 through the introduction opening 12, first, the engaging projection 5 of the striker S hits the inclined surface 18*e* of the engaging projection 18*c* of the elastic member 18 and gradually bends the elastic member 18 toward the side chamber 17. Then, when the striker S is further inserted so that a top edge of the engaging projection 5 of the striker S passes over a top edge of the engaging projection 18*c* of the elastic member 18 to be located at a predetermined position, the elastic member 18 is allowed to return to the side of the holding chamber 11. With the elastic return of the elastic member 18, the engaging surface 18*d* of the engaging projection 18*c* of the elastic member 18 can engage the engaging projection 5 of the striker S on the insertion side of the striker S. Thus, the striker S can not be extracted from the holding chamber 11 unless the striker S is pulled with a large force such that the elastic member 18 is bent toward the side chamber 17.

Incidentally, in the present embodiment, the striker S includes a hook shape connecting portion 7 having a curved portion 7*a* projecting toward the elastic member 18 between a pair of side plate members 6. The side plate members 6 have widths such that the side plate members contact wall surfaces 11*a* for sandwiching the elastic member 18 and a wall surface 11*b* of the holding chamber 11 opposed to the wall surfaces 11*a* in a lengthwise direction thereof. In the striker S, the curved projection portion 7*a* of the connecting portion 7 cooperates with the engaging projection 18*c*. Also, the engaging projection 18*c* of the elastic member 18 enters between the pair of the side plate members 6 of the striker S as the striker S is inserted into the holding chamber 11.

Also, the striker S includes a fixing portion 8 to be fixed to a member, which is attached to the latch unit R fixed to the object 100', on a side opposite to the striker S to be inserted into the holding chamber 11 of the latch unit R. The fixing portion 8 is separated from a portion to be inserted into the holding chamber 11 by an outer flange portion 9, and has a hollow square shape in a lateral section. The fixing portion 8 further includes elastic attaching pieces 80 provided on opposed side surfaces thereof, which have edges projecting toward the outer flange portion 9 and formed by slits 81 extending through the fixing portion 8. Each elastic attaching piece 80 includes an engaging projection 80*a* with an engaging surface 80*b* facing the outer flange portion 9.

As a result, in the present embodiment, the striker S can also be attached to the member mentioned above with one touch operation by inserting the fixing portion 8 into an attaching hole 201 formed in the member until the outer flange portion 9 abuts against the member. Upon insertion of the fixing portion 8, the elastic attaching pieces 80 are bent inwardly when the engaging projections 80*a* hit a hole edge of the attaching hole 201, and the elastic attaching pieces 80 elastically return to the original shapes after top edges of the engaging projections 80*a* pass over the hole edge, to thereby sandwich the hole edge of the attaching hole 201 by the outer flange portion 9 and the engaging surfaces 80*b* of the engaging projections 80*a*.

On the other hand, the side chamber 17 in the latch unit R houses a responding or weight member 2 in a movable state in approximately the same direction as the striker goes in and out.

Long guide holes 17*a* extending along a moving direction of the responding member 2 are formed on side plates for constituting the side chamber 17, located on both sides of the elastic member 18. On the other hand, guide projections 21 having sizes to be fitted into the long guide holes 17*a* are provided on both sides of the responding member 2. The responding member 2 is assembled to travel along the long guide holes 17*a* with the guide projections 21 fitted thereinto.

Also, the side chamber 17 is closed on the side of a front surface 13 of the casing 1, and is open on the side of a rear surface 16. A compressing coil spring 3*a* for urging the responding member 2 toward the rear surface 16 of the casing 1 is provided between an inner surface 17*c* of the closed side of the side chamber 17 and the responding member 2. More specifically, the responding member 2 is provided with an open blind hole 22 on a side facing the inner surface 17*c* on the closed side of the side chamber 17, and a projection 17*b* with a size enough to enter into the open blind hole 22 is formed on the inner surface 17*c* on the closed side. The compressing coil spring 3*a* is disposed over the projection 17*b* at one end, and is inserted into the blind hole 22 at the other end.

Also, in the present embodiment, the elastic member 18 is provided with a protruded portion 18*f* on the side facing the side chamber 17 with a height close to an imaginary plane M passing through a controlling side surface 23 of the responding member 2 facing the elastic member 18. In the present embodiment, under the condition where the inertial force or impact force is not applied, described later, the responding member 2 is held at a position where the guide projections 21 are pressed against lower edges of the long guide holes 17*a* on the side of the rear surface 16 of the casing 1 (hereinafter referred to as "ordinary position OD" of the responding member 2). In the ordinary position OD of the responding member 2, the edge portion 24 of the responding member 2 facing the front surface 13 of the casing 1 is positioned under the protruded portion 18*f* of the elastic member 18 to thereby allow the controlling side surface 23 not to contact the protruded portion 18*f*, as shown in FIG. 1. In other words, in the present embodiment, the compressing coil spring 3*a* is an urging device 3 for always urging the responding member 2 toward the base portion of the elastic member 18.

On the other hand, in the present embodiment, an urging force of the compressing coil spring 3*a* is set to an extent that in case at least the inertia force or impact force is applied to the member with which the striker S held in the holding chamber 11 is assembled due to collision or sudden braking of a car or the like and the striker S is pulled by such a big force that the elastic member 18 is bent toward the side chamber 17 to release an engagement between the striker S and the engaging projection 18*c* of the elastic member 18, the responding member 2 is allowed to move toward the protruded portion of the elastic member 18 by such a big inertia force and impact force.

Figure 2:
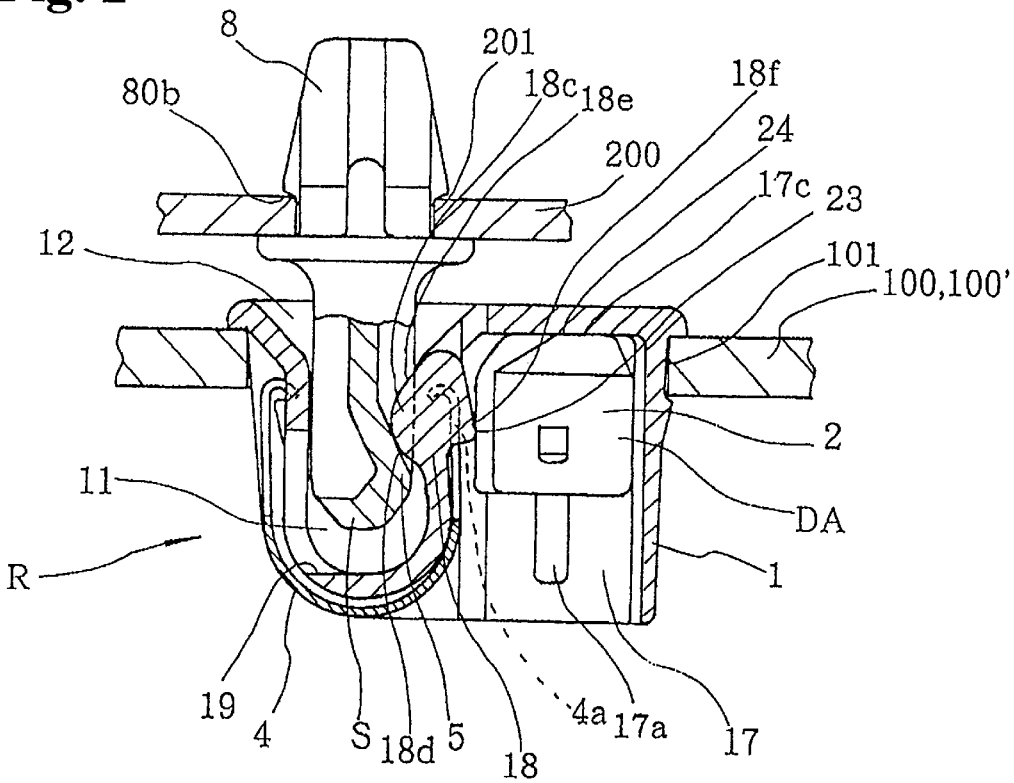
FIG. 2 is a sectional view showing another using state thereof.
Figure 3:
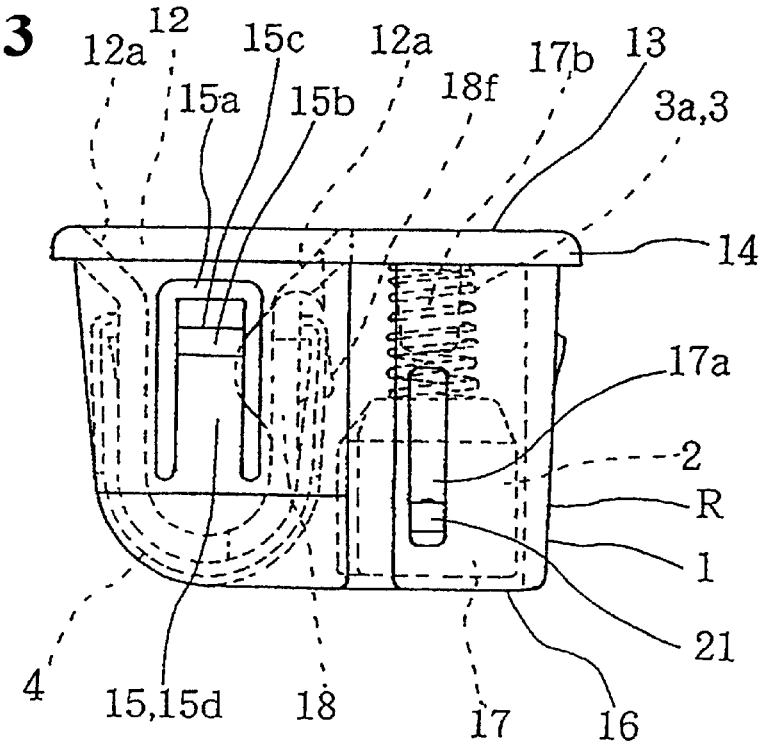
FIG. 3 is a side view of the latch unit.

As a result, in the present embodiment, in case such big inertia force or impact force is at least applied, the responding member 2 can be moved to a position where the edge portion 24 of the responding member 2 facing the front surface 13 of the casing 1 abuts against the inner surface 17*c* on the closed side of the side chamber 17 (hereinafter referred to as "emergency position DA" of the responding member 2). In the emergency position DA, since the controlling side surface 23 of the responding member 2 contacts the forward edge of the protruded portion 18*f* of the elastic member 18, the elastic member 18 can be prevented from being bent toward the side chamber 17. Thus, an unexpected extraction of the striker S from the holding chamber 11, i.e. an unexpected detachment of the member to which the striker S is attached from the object 100' to which the latch unit R is attached, by the inertia force or the impact force can be prevented, as shown in FIG. 2.

The amount of the inertia force or impact force causing the responding member 2 to move from the ordinary position OD to the emergency position DA can be adjusted by changing the urging force of the urging device and a weight of the responding member 2. Typically, the responding member 2 is set to start moving first by inertia force or impact force, i.e. smaller force than the force to start moving the member to which the striker S is attached for allowing the striker S to be extracted from the holding chamber 11.

According to the latch unit R of the present embodiment, there is provided an attaching device having a function for preventing the striker S from being extracted when the inertia force or impact force is applied thereto, by inserting the casing 1 for assembly into the attaching hole 101 of the object 100' to which the latch unit R is attached. The attaching device thus structured can be easily applied to the member which requires such attaching device.

Also, the responding member 2 is stably positioned at the ordinary position OD where the elastic member 18 is not prevented from being bent toward the side chamber 17, by the urging force of the urging device 3 unless the inertia force or impact force is applied thereto. Thus, even if the latch unit R is attached so that the front surface 13 of the casing 1 faces upwards, sidewards or downwards, any operation of insertion or engagement of the striker S with the holding chamber 11 and extraction or releasing of the striker S from the holding chamber 11 can be carried out without problem in the ordinary state.

Incidentally, in the present embodiment, on an outer side of the holding chamber 11 in the casing 1, for increasing a holding force of the striker S inserted into the holding chamber 11, there is provided a spring plate 4 in a curved shape having a groove 4*a* for allowing the protruded portion 18*f* of the elastic member 18 to project toward the side chamber 17. The spring plate 4 is fitted in a pressed state for urging the inner surface of the elastic member 18 in the holding chamber 11 toward the side wall 11*b* opposite thereto.

Also, on both side walls 11*a*, 11*b* of the holding chamber 11*n* the side of the introduction opening 12, inclined surfaces 12*a* are provided in a direction enlarging the holding chamber 11 from an inner side of the holding chamber 11 to the introduction opening 12 for receiving the striker S easily.

Also, by forming the casing 1 with a material having an elastically deformable characteristic, such as plastics, the elastic member 18 can be easily provided with an elastically deformable characteristic.

According to the latch unit of the present invention, there is provided a structure wherein not only an engaging operation and disengaging operation of the latch and the striker under the normal condition can be carried out without any problems, but also the engagement between the latch and the striker can not be released by the inertia force or the impact force at an emergency occasion, such as a collision of a car. By only installing the structure into the attaching hole of the object to which the latch unit is attached for assembly, the attaching device can be easily and properly attached.

While the invention has been explained with reference to a specific embodiment of the invention, the explanation is illustrative and the invention is limited only by the appended claims.

What is claimed is:

1. A latch unit comprising:

a casing having a holding chamber for holding a striker with an engaging portion, a side chamber situated adjacent to the holding chamber, and an introduction opening communicating with the holding chamber for introducing the striker into the holding chamber;

a responding member movably situated in the side chamber;

an elastic member situated in the casing to separate the holding chamber and the side chamber and projecting toward the introduction opening from an inner portion of the holding chamber, said elastic member having a base portion fixed to the casing and an engaging projection protruding inwardly of the holding chamber, said engaging projection, when the engaging portion of the striker is fully inserted into the holding chamber, being located in the holding chamber at a side of the introduction opening relative to the engaging portion of the striker to thereby prevent the engaging portion of the striker from being extracted from the holding chamber; and an urging device situated in the side chamber for urging the responding member to a side of the base portion of the elastic member and having an urging force such that when a force is applied to the striker for urging the engaging portion of the striker to disengage from the engaging projection, the responding member is moved at a side near the engaging projection to prevent the striker from disengaging from the latch unit.

2. A latch unit according to claim 1, wherein said casing is installed in an attaching hole of a fixed object, and said latch is actuated such that as the striker is inserted into the holding chamber through the introduction opening, the elastic member is bent toward the side chamber by abutment with the engaging portion of the striker, and when the striker is fully inserted into the holding chamber, the elastic member is returned to an original position to thereby allow the engaging projection of the elastic member to engage the engaging portion of the striker.

3. A latch unit according to claim 2, wherein said casing further includes an engaging device for installing the casing in the attaching hole of the fixed object.

4. A latch unit according to claim 1, wherein said casing includes elongated guide holes at a portion surrounding the side chamber, and said responding member has guide projections engaging the guide holes so that the responding member moves along the guide holes.

5. A latch unit according to claim 4, wherein said casing further includes a projection projecting into the side chamber, and said responding member further includes a recess at a side facing the projection.

6. A latch unit according to claim 5, wherein said urging device is a coil spring, one end being situated in the recess, and the other end being disposed over the projection.

7. A latch unit according to claim 1, wherein said elastic member includes a protruded portion extending in a direction opposite to the engaging projection, said protruded portion engaging the responding member when the responding member is located near the engaging projection.

8. A latch unit according to claim 7, further comprising a spring attached to the casing to hold the base portion of the elastic member for reinforcing the same.

* * * * *